US011765539B2

(12) United States Patent
Armstrong et al.

(10) Patent No.: US 11,765,539 B2
(45) Date of Patent: Sep. 19, 2023

(54) AUDIO PERSONALISATION METHOD AND SYSTEM

(71) Applicant: Sony Interactive Entertainment Inc., Tokyo (JP)

(72) Inventors: Calum Armstrong, London (GB); Marina Villanueva Barreiro, Acoruña (ES); Alexei Smith, London (GB); Michael Lee Jones, London (GB); Fabio Cappello, London (GB)

(73) Assignee: Sony Interactive Entertainment Inc., Tokyo (JP)

( * ) Notice: Subject to any disclaimer, the term of this patent is extended or adjusted under 35 U.S.C. 154(b) by 52 days.

(21) Appl. No.: 17/522,052

(22) Filed: Nov. 9, 2021

(65) Prior Publication Data

US 2022/0150658 A1 May 12, 2022

(51) Int. Cl.
*H04S 7/00* (2006.01)
*H04S 3/00* (2006.01)

(52) U.S. Cl.
CPC ..... *H04S 7/303* (2013.01); *H04S 3/002* (2013.01); *H04S 3/008* (2013.01); *H04S 2400/01* (2013.01); *H04S 2400/11* (2013.01); *H04S 2420/01* (2013.01); *H04S 2420/11* (2013.01)

(58) Field of Classification Search
CPC ..... H04S 7/303; H04S 3/002; H04S 3/008; H04S 2400/01; H04S 2400/11; H04S 2420/01; H04S 2420/11
See application file for complete search history.

(56) References Cited

U.S. PATENT DOCUMENTS

| | | | | |
|---|---|---|---|---|
| 9,848,273 | B1 | 12/2017 | Helwani | |
| 10,425,762 | B1 | 9/2019 | Schissler | |
| 2007/0092085 | A1 | 4/2007 | Katayama | |
| 2018/0324542 | A1 * | 11/2018 | Seo | H04R 5/02 |
| 2020/0336858 | A1 | 10/2020 | William, II | |

FOREIGN PATENT DOCUMENTS

| | | | | |
|---|---|---|---|---|
| EP | 3188513 | A2 * | 7/2017 | H04R 1/10 |
| KR | 20200126429 | A * | 11/2020 | H04S 7/303 |
| WO | WO-2016089180 | A1 * | 6/2016 | H04S 1/00 |

OTHER PUBLICATIONS

Extended European Search Report for corresponding EP Application No. 21207292.0, 7 pages, dated Apr. 11, 2022.
Combined Search and Examination Report for corresponding GB Application No. 2017814.1, 5 pages, dated May 11, 2021.

* cited by examiner

*Primary Examiner* — David L Ton
(74) *Attorney, Agent, or Firm* — Matthew B. Dernier, Esq.

(57) ABSTRACT

An audio personalisation method for a user, to reproduce an area-based or volumetric sound source, includes the steps of, for a head related transfer function 'HRTF' associated with the user, smoothing HRTF coefficients relating to peaks and notches in the HRTF's spectral response, responsive to the size of the area or volume of the sound source; filtering the sound source using the smoothed HRTF for the notional position of the sound source; and outputting the filtered sound source signal for playback to the user.

14 Claims, 6 Drawing Sheets

AUDIO PERSONALISATION METHOD AND SYSTEM

BACKGROUND OF THE INVENTION

Field of the Invention

The present invention relates to an audio personalisation method and system.

Description of the Prior Art

Consumers of media content, including interactive content such as videogames, enjoy a sense of immersion whilst engaged with that content. As part of that immersion, it is also desirable for the audio to sound more realistic. However, techniques for achieving this realism tend to be complex and require specialist equipment.

The present invention seeks to mitigate or alleviate this problem.

SUMMARY OF THE INVENTION

Various aspects and features of the present invention are defined in the appended claims and within the text of the accompanying description and include at least:

In a first aspect, an audio personalisation method for a user is provided in accordance with claim 1.

In another aspect, an audio personalisation system for a user is provided in accordance with claim 13.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE EMBODIMENTS

An audio personalisation method and system are disclosed. In the following description, a number of specific details are presented in order to provide a thorough understanding of the embodiments of the present invention. It will be apparent, however, to a person skilled in the art that these specific details need not be employed to practice the present invention. Conversely, specific details known to the person skilled in the art are omitted for the purposes of clarity where appropriate.

In an example embodiment of the present invention, a suitable system and/or platform for implementing the methods and techniques herein may be an entertainment device such as the Sony PlayStation 4® or PlayStation 5® videogame consoles.

For the purposes of explanation, the following description is based on the PlayStation 4® but it will be appreciated that this is a non-limiting example.

Figure 1:
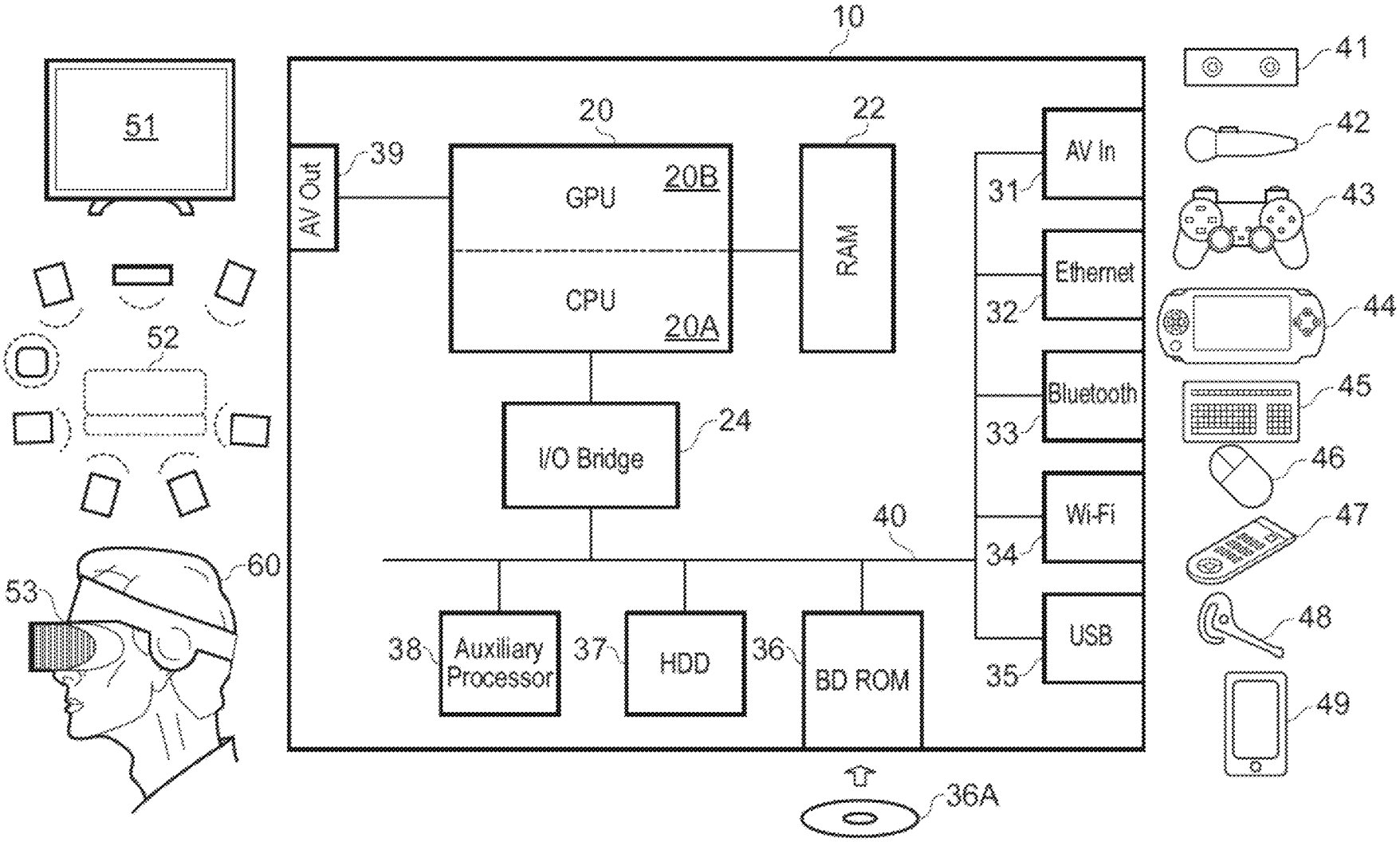
FIG. 1 is a schematic diagram of an entertainment device in accordance with embodiments of the present description.

Referring now to the drawings, wherein like reference numerals designate identical or corresponding parts throughout the several views, FIG. 1 schematically illustrates the overall system architecture of a Sony® PlayStation 4® entertainment device. A system unit 10 is provided, with various peripheral devices connectable to the system unit.

The system unit 10 comprises an accelerated processing unit (APU) 20 being a single chip that in turn comprises a central processing unit (CPU) 20A and a graphics processing unit (GPU) 20B. The APU 20 has access to a random access memory (RAM) unit 22.

The APU 20 communicates with a bus 40, optionally via an I/O bridge 24, which may be a discreet component or part of the APU 20.

Connected to the bus 40 are data storage components such as a hard disk drive 37, and a Blu-ray® drive 36 operable to access data on compatible optical discs 36A. Additionally the RAM unit 22 may communicate with the bus 40.

Optionally also connected to the bus 40 is an auxiliary processor 38. The auxiliary processor 38 may be provided to run or support the operating system.

The system unit 10 communicates with peripheral devices as appropriate via an audio/visual input port 31, an Ethernet® port 32, a Bluetooth® wireless link 33, a Wi-Fi® wireless link 34, or one or more universal serial bus (USB) ports 35. Audio and video may be output via an AV output 39, such as an HDMI® port.

The peripheral devices may include a monoscopic or stereoscopic video camera 41 such as the PlayStation® Eye; wand-style videogame controllers 42 such as the PlayStation® Move and conventional handheld videogame controllers 43 such as the DualShock® 4; portable entertainment devices 44 such as the PlayStation® Portable and PlayStation® Vita; a keyboard 45 and/or a mouse 46; a media controller 47, for example in the form of a remote control; and a headset 48. Other peripheral devices may similarly be considered such as a printer, or a 3D printer (not shown), or a mobile phone 49 connected for example via Bluetooth® or Wifi Direct®.

The GPU 20B, optionally in conjunction with the CPU 20A, generates video images and audio for output via the AV output 39. Optionally the audio may be generated in conjunction with or instead by an audio processor (not shown).

The video and optionally the audio may be presented to a television 51. Where supported by the television, the video may be stereoscopic. The audio may be presented to a home cinema system 52 in one of a number of formats such as stereo, 5.1 surround sound or 7.1 surround sound. Video and audio may likewise be presented to a head mounted display unit 53 worn by a user 60.

In operation, the entertainment device defaults to an operating system such as a variant of FreeBSD® 9.0. The operating system may run on the CPU 20A, the auxiliary processor 38, or a mixture of the two. The operating system provides the user with a graphical user interface such as the PlayStation® Dynamic Menu. The menu allows the user to access operating system features and to select games and optionally other content.

When playing such games, or optionally other content, the user will typically be receiving audio from a stereo or surround sound system 52, or headphones, when viewing the content on a static display 51, or similarly receiving audio from a stereo surround sound system 52 or headphones, when viewing content on a head mounted display ('HMD') 53.

In either case, whilst the positional relationship of in game objects either to a static screen or the user's head position (or a combination of both) can be displayed visually with relative ease, producing a corresponding audio effect is more difficult.

This is because an individual's perception of direction for sound relies on a physical interaction with the sound around them caused by physical properties of their head; but everyone's head is different and so the physical interactions are unique.

Figure 2A:
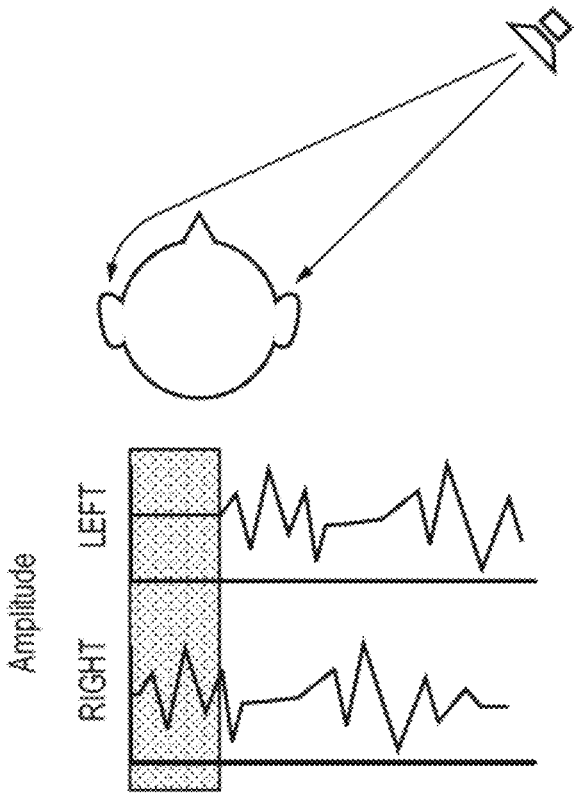
FIGS. 2A and 2B are schematic diagrams of head related audio properties.

Referring to FIG. 2A, an example physical interaction is the interaural delay or time difference (ITD), which is indicative of the degree to which a sound is positioned to the left or right of the user (resulting in relative changes in arrival time at the left and right ears), which is a function of the listener's head size and face shape.

Figure 2B:
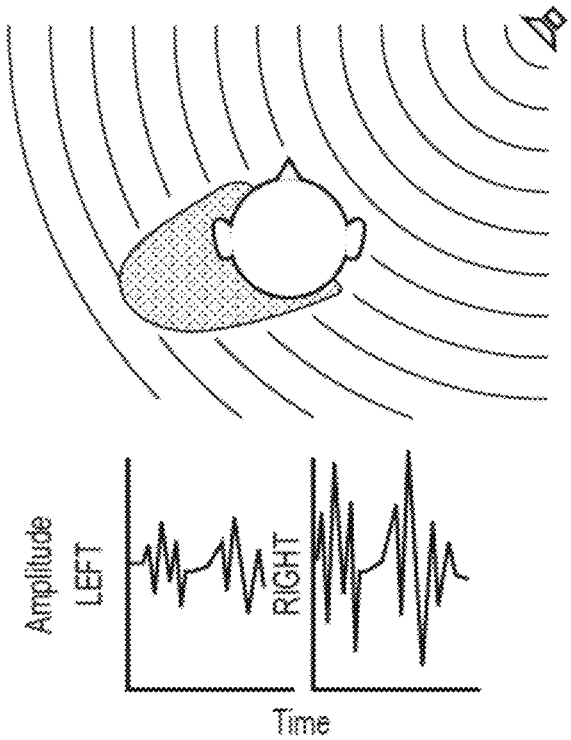

Similarly, referring to FIG. 2B, interaural level difference (ILD) relates to different loudness for left and right ears and is indicative of the degree to which a sound is positioned to the left or right of the user (resulting in different degrees of attenuation due to the relative obscuring of the ear from the sound source), and again is a function of head size and face shape.

Figure 3A:
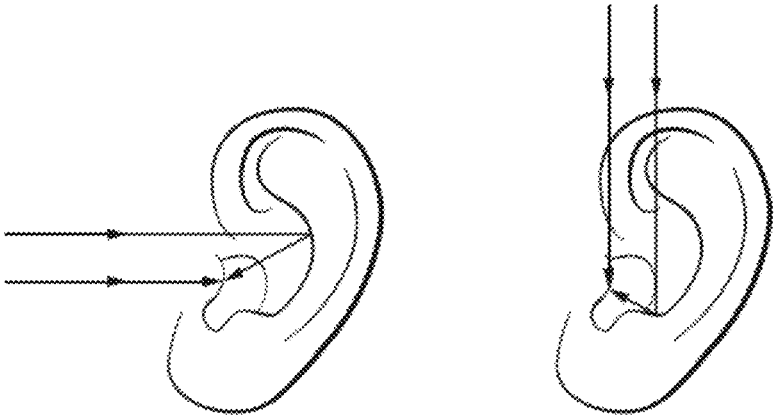
FIGS. 3A and 3B are schematic diagrams of ear related audio properties.
Figure 3B:
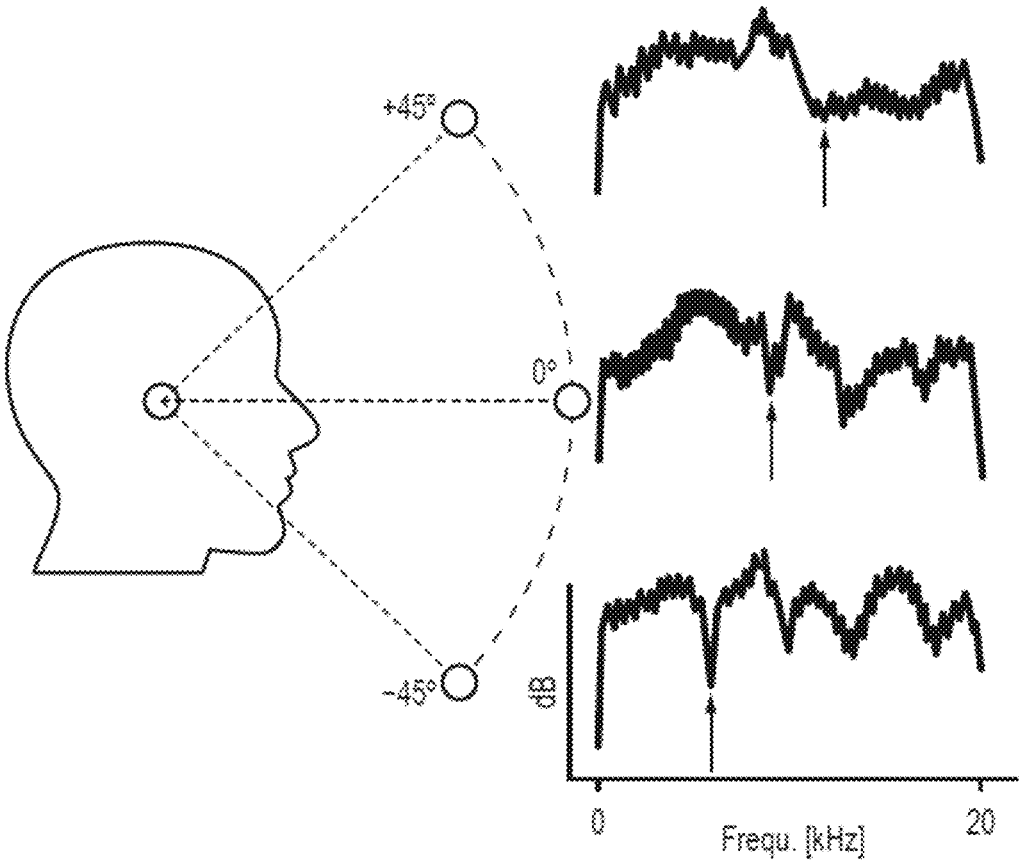

In addition to such horizontal (left-right) discrimination, referring also to FIG. 3A the outer ear comprises asymmetric features that vary between individuals and provide additional vertical discrimination for incoming sound; referring to FIG. 3B, the small difference in path lengths between direct and reflected sounds from these features cause so-called spectral notches that change in frequency as a function of sound source elevation.

Furthermore, these features are not independent; horizontal factors such as ITD and ILD also change as a function of source elevation, due to the changing face/head profile encountered by the sound waves propagating to the ears. Similarly, vertical factors such as spectral notches also change as a function of left/right positioning, as the physical shaping of the ear with respect to the incoming sound, and the resulting reflections, also change with horizontal incident angle.

The result is a complex two-dimensional response for each ear that is a function of monaural cues such as spectral notches, and binaural or inter-aural cues such as ITD and ILD. An individual's brain learns to correlate this response with the physical source of objects, enabling them to distinguish between left and right, up and down, and indeed forward and back, to estimate an object's location in 3D with respect to the user's head.

It would be desirable to provide a user with sound (for example using headphones) that replicated these features so as to create the illusion of in-game objects (or other sound sources in other forms of consumed content) being at specific points in space relative to the user, as in the real world. Such sound is typically known as binaural sound.

However, it will be appreciated that because each user is unique and so requires a unique replication of features, this would be difficult to do without extensive testing.

Figure 4A:
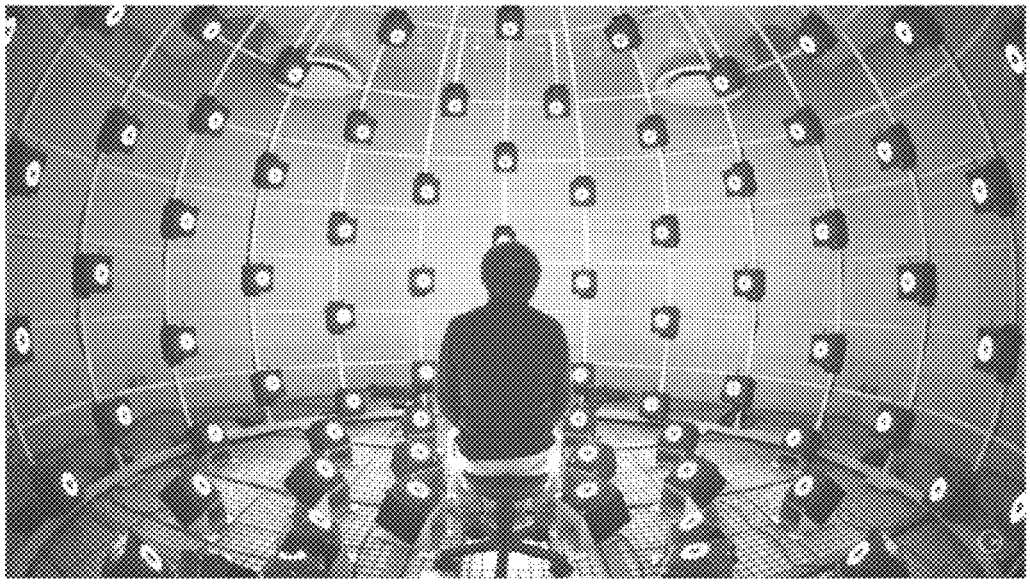
FIGS. 4A and 4B are schematic diagrams of audio systems used to generate data for the computation of a head related transfer function in accordance with embodiments of the present description.
Figure 4B:
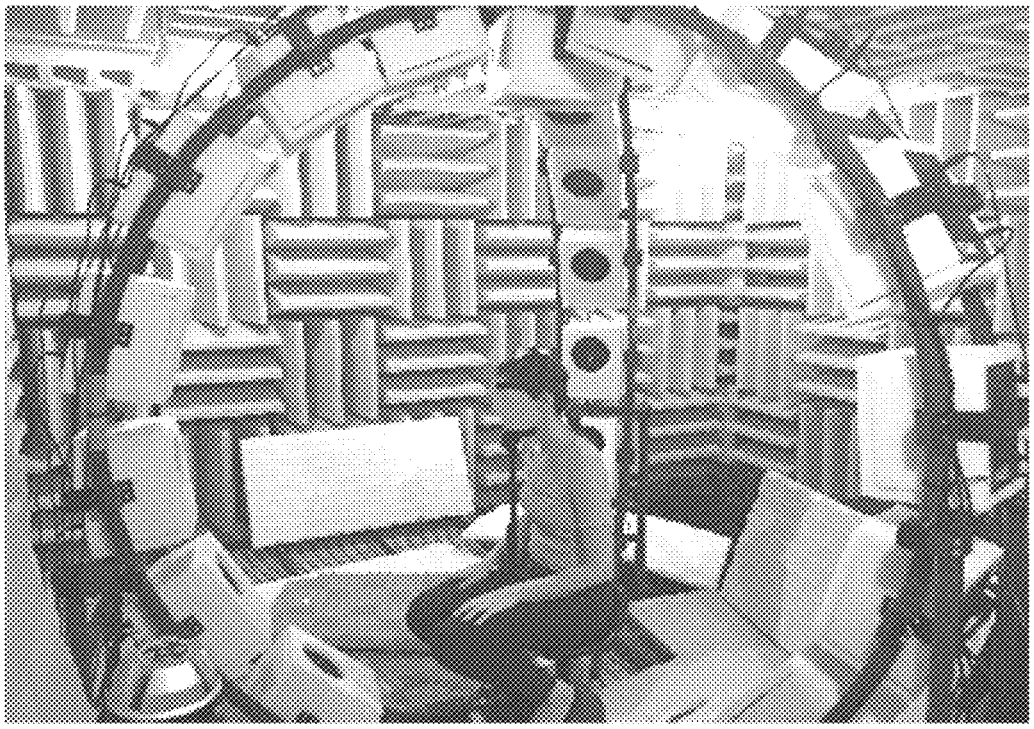

In particular, it is necessary to determine the in-ear impulse or frequency response of the user for a plurality of positions, for example in a sphere around them; FIG. 4A shows a fixed speaker arrangement for this purpose, whilst FIG. 4B shows a simplified system where, for example, the speaker rig or the user can rotate by fixed increments so that the speakers successively fill in the remaining sample points in the sphere.

Figure 5:
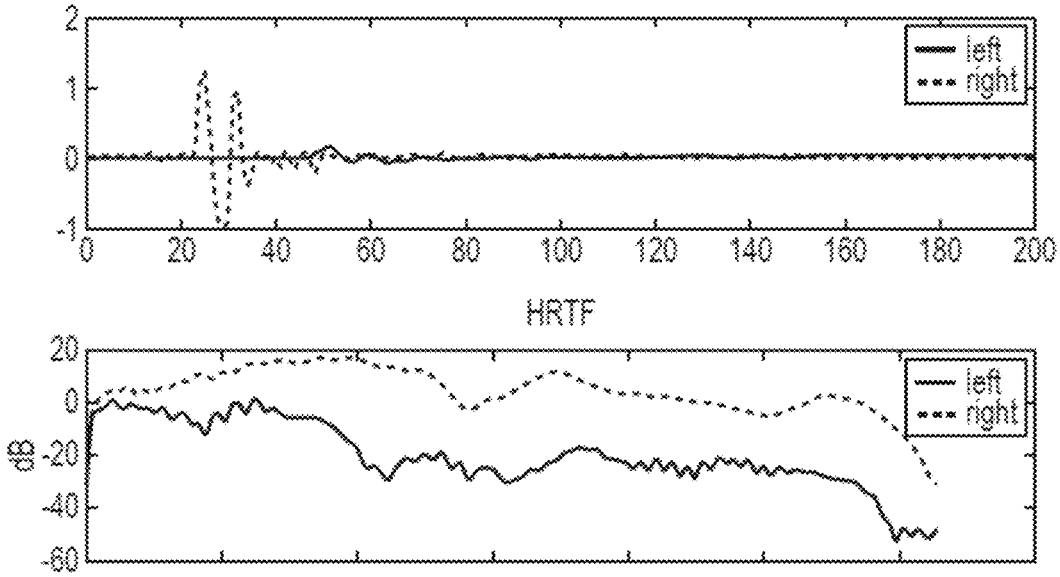
FIG. 5 is a schematic diagram of an impulse response for a user's left and right ears in the time and frequency domains.

Referring to FIG. 5, for a sound (e.g. an impulse such as a single delta or click) at each sampled position, a recorded impulse response within the ear (for example using a microphone positioned at the entrance to the ear canal) is obtained, as shown in the upper graph. A Fourier transform of such an impulse response is referred to as a frequency response, as shown in the lower graph of FIG. 5. Collectively, these impulse responses or frequency responses can be used to define a so-called head-related transfer function (HRTF) describing the effect for each ear of the user's head on the received frequency spectrum for that point in space.

Figure 6:
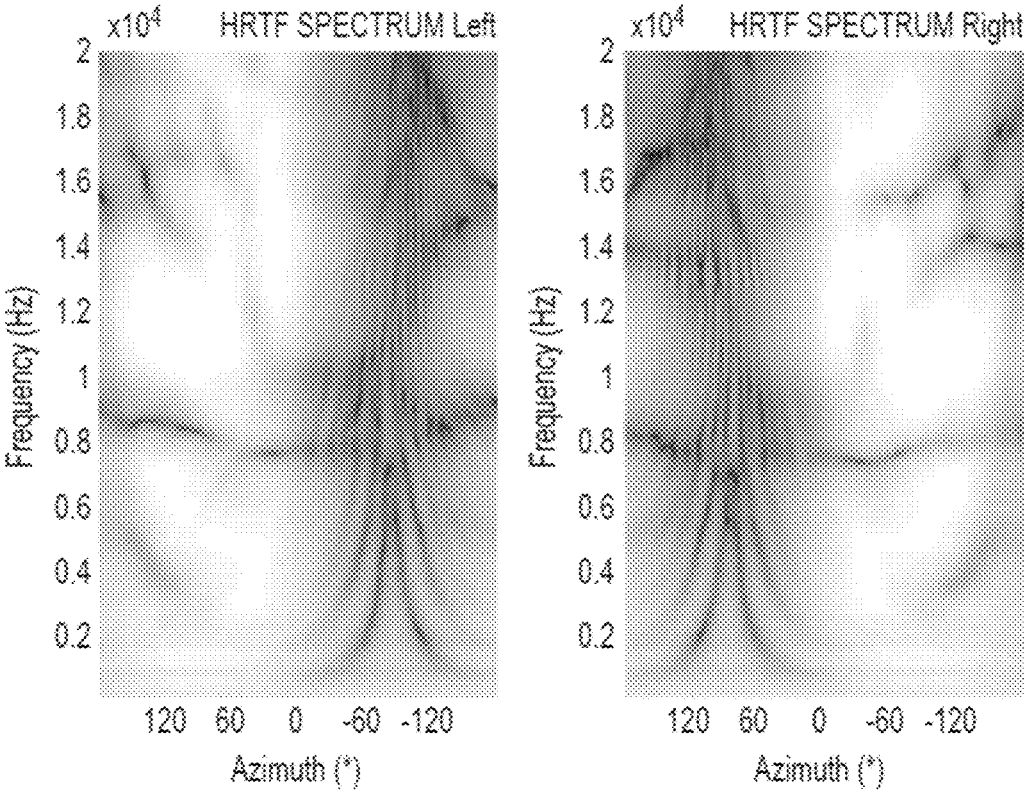
FIG. 6 is a schematic diagram of a head related transfer function spectrum for a user's left and right ears.

Measured over many positions, a full HRTF can be computed, as partially illustrated in FIG. 6 for both left and right ears (showing frequency on the y-axis versus azimuth on the x-axis). Brightness is a function of the Fourier transform values, with dark regions corresponding to spectral notches.

An HRTF typically comprises a time or frequency filter (e.g. based on an impulse or frequency response) for a series of positions on a sphere or partial sphere surrounding the user's head (e.g. for both azimuth and elevation), so that a sound, when played through a respective one of these filters, appears to come from the corresponding positon/direction. The more measured positions on which filters are based, the better the HRTF is. For positions in between measured positions, interpolation between filters can be used. Again, the closer the measurement positions are to each other, the better (and less) interpolation there is.

It will be appreciated that obtaining an HRTF for each of potentially tens of millions of users of an entertainment device using systems such as those shown in FIGS. 4A and 4B is impractical, as is supplying some form of array system to individual users in order to perform a self-test.

Accordingly, several possible approached to obtaining or identifying HRTFs for end users at scale have been considered.

In a first approach, an audio personalisation method for a user may comprise the steps of capturing at least a first image of a user comprising a view of their head, wherein at least one of the captured images comprises a reference feature of known absolute size in a predetermined relationship to the user's head; analysing the or each captured image to generate data characteristic of the morphology of the user's head, responsive to the known absolute size of the reference feature; for a corpus of reference individuals for whom respective head related transfer functions 'HRTF's have been generated, comparing some or all of the generated data from the user with corresponding data of some or all respective reference individuals in the corpus; identifying a reference individual whose generated data best matches the generated data from the user; and using the HRTF of the identified reference individual for the user.

In this way a parameterisation of the user's head & ears could be performed to find a close match with a reference individual in a library, for whom an HRTF had already been obtained.

In a second approach, and in a similar vein, an audio personalisation method for a first user may comprises the steps of testing a first user on a calibration test, the calibration test comprising: requiring a user to match a test sound to a test location, either by controlling the position of the presented sound or controlling the position of the presented location, for a sequence of test matches, each test sound being presented at a position using a default HRTF, receiving an estimate of each matching location from the first user, and calculating a respective error for each estimate, to generate a sequence of location estimate errors for the first user; and then comparing at least some of the location estimate errors for the first user with estimate errors of the same locations previously generated for at least a subset of a corpus of reference individuals; identifying a reference individual with the closest match of compared location estimation errors to those of the first user; and using an HRTF, previously obtained for the identified reference individual, for the first user.

Hence again the aim is to match a user to a reference individual, this time based on the extent to which both the user and the reference individual (who undergoes a similar test) make mistakes localising sounds that are played using a common default HRTF; the mistakes are a proxy for the differences between the default HRTF and the user's HRTF, and hence finding a matching set of errors among the reference individuals will also find a similar corresponding HRTF.

In a third approach, and again in a similar vein, an audio personalisation method for a user may comprise the steps of testing the user with an audio test, the audio test comprising: moving a portable device, comprising a position tracking mechanism and a speaker, to a plurality of test positions relative to the user's head; playing a test sound through the speaker of the portable device; and detecting the test sound using a microphone at least proximate to each of the user's ears, and associating resulting measurement data with the corresponding test position, wherein the resulting measurement data derived from the detected test sounds is characteristic of the user's head morphology; for a corpus of reference individuals for whom respective head-related transfer functions 'HRTF's have been generated, comparing the measurement data from the user's audio test or an HRTF derived from this measurement data with corresponding measurement data of some or all respective reference individuals in the corpus or HRTFs of some or all respective reference individuals in the corpus; identifying a reference individual whose measurement data or HRTF best matches the measurement data or HRTF from the user's audio test; and using the HRTF of the identified reference individual for the user.

Hence in this case an approximate HRTF (or precursor audio measurements) are collected for the end user, and compared with corresponding data for the reference individuals to find a match; the full HRTF for that reference individual can then be used for the end user.

Of course, in a fourth approach an end user could obtain a full HRTF using a system such as that shown in FIG. 4A or 4B (for example at a walk-in centre with the equipment), or the measurements made during the second or third approach above may be adequate to synthesize an acceptable HRTF.

In any event, the end user may obtain an HRTF, which enable the reproduction of 3D audio directional sources by combining the raw sound source with the HRTF for a given position, the HRTF providing the relevant inter-aural time delay, inter-aural level delay, and spectral response expected by the ears of the user for that position.

This allows the HRTF to spatialise a physically small source such as a person speaking or a bird tweeting, for example within a videogame or other immersive content.

However, in embodiments of the present description, it is also desirable to use an HRTF to spatialize (i.e. appear to position in space) physically large or volumetric sources, such as rivers or busy roads, that typically form part of the wider environment in such videogames.

These large sources are problematic, because they generate sound over a large area rather than a given point position. Hence conventionally to represent these sources it has been necessary to generate a plurality of point sources distributed over the large source as a form of spatial sampling. However, this is unsatisfactory firstly because the user can sometimes tell that there are plural sources, and secondly because the computational cost of multiple sound sources being filtered in this manner is high.

In embodiments of the present description it has been appreciated that due for example to a river having multiple sources of sound at different positions with respect to the user, such large sources have a plurality of audio paths with different time, level and phase properties between them.

If one were to superpose or aggregate these signals, the phase in particular would lose significance. As noted elsewhere herein, phase and position information is primarily obtained through spectral peaks and notches in the HRTF's spectral response (plus ITD for basic left/right localisation).

A superposition of these phases due to the line/area/volumetric dimensions of the source (rather than a point source) would result in these peaks and notches becoming wider & shallower, and optionally result in a wider distribution of ITDs.

Hence one can model the superposition of paths from a large source by smoothing the peaks and notches in the HRTF's spectral response for the average position of the source. To a first approximation, the larger the source, the greater the smoothing.

The smoothing can be achieved using any suitable signal processing technique, such as applying a moving average filter, or a spatial smoothing filter when treating the HRTF values as a 2D or 3D array, such as dilation.

The smoothing serves to simulate the chaotic or random superposition of phases and source positions likely to be experienced by a person when listening to a large or distributed source such as a river.

The degree of smoothing can be made proportional to the notional size of the source compared to a notional size of a point source or position. It will be appreciated that a typical HRTF is itself a discrete approximation of the continuous variations in filter parameters with direction created by the user's ear, typically by sampling the space around a person at (as a non-limiting example) every 10 degrees of arc. The effective spatial sampling granularity may be any value but can serve as the default size of the notional point source when using the unsmoothed HRTF. Large objects can be evaluated with respect to this sampling granularity, so that for example if the sampling granularity was 5 degrees, and the object spans 10 degrees, then the HRTF for the direction or directions corresponding the object may be smoothed to be 50% as accurate as before. If the object spans 15 degree, then the HRTF for that area may be smoothed to be 33% as accurate as before.

As noted above, the HRTF can be smoothed using a suitable filter, and/or the values for the HRTF directions that the object occupies (or optionally is also proximate to) may be averaged, or superposed and normalised, to create a blended HRTF filter for the object. Either approach can be referred to herein as 'smoothed'.

In each case, the object is then represented by the source sound(s) and one smoothed HRTF filter corresponding to the object's average or perceived positon. It will be appreciated that multiple sounds can be filtered with this one filter to simulate variability in the source.

In particular, whilst HRTFs allow localisation as a function of direction (and thus smoothing the HRTF expands the localisation from a point to an area), they do not necessarily allow localisation as a function of distance (although the human brain can also infer this from corresponding visual cues, for example); therefore to enhance the effect for a volumetric source, multiple versions of the sound may be filtered using the smoothed HRTF filter but at different global delays (and optionally global attenuations) corresponding to increasing distances within the volume.

Clearly also a combination of these approaches can optionally be used so that a river, for example, that is at an angle with respect to the user may have an overall size of, say 60 degrees of arc, spanning 12 HRTF filter positions at 5 degree separations, but this can be divided into four sets of large objects each with 15 degrees of arc, and use different global delays, and optionally attenuation, to capture the change of distance for each segment of the river as it recedes.

Clearly also a smoothed HRTF can be used in conjunction with an unsmoothed or 'full resolution' HRTF; hence for example the smoothed HRTF could be used for general river sounds, whilst nearby fish splashing in the river could use the full resolution HRTF.

Hence the technique can comprise dividing the space around the user into a grid or array of directions each corresponding to an HRTF sampling point, and then for a given direction smoothing the corresponding HRTF filter, or equivalently averaging or blending it with neighbouring filters, depending on how many of the grid or array of directions the large object occupies. Optionally the volume of the object can be represented further by the use of the sound with different global delays, and similarly such global delays can be used where a long sound source such as a river or road recedes at an angle from the user.

In a similar manner to the above, one may use so-called 'Ambisonics', which is a spatial audio format that in effect parcels the audio environment up into a series of different size grids. In Ambisonics, an entire directional sound field can be stored as a finite number of distinct 'channels' (as opposed to an object format where individual sources are stored separately along with positional meta-data). Each channel represents a specific spatial portion of the soundfield, with higher numbered channels representing more precise directions. Audio sources can be encoded into Ambisonics by weighting the source onto each channel with a gain value equivalent to the value of a spherical harmonic component at the desired angle of the source.

Hence Ambisonics is a soundfield reconstruction technique, similar to Wave Field Synthesis, where loudspeaker signals are generated such that the harmonic mode excitations within the centre of a playback array are matched with those of the original soundfield.

Ambisonics can be stored at different 'orders' with higher orders including more channels. Higher order Ambisonics can therefore represent a higher resolution soundfield to the limit that an infinitely high order Ambisonic mix (which includes an infinite number of channels) is equivalent to perfect object based audio rendering. Lower order Ambisonics meanwhile results in blurred/spread out sources, similar to a 2D or 3D version of low-pass filtering or muffling the sound.

Conventionally such blurred sources are considered bad, but when intentionally rendering a large or volumetric source, this may be exploited.

Sources can be manually blurred in higher order Ambisonics by increasing the gain of the specific source on the W Channel. The W channel is the first channel and is omnidirectional. Doing this therefore increases the omnidirectional reproduction of the source in the rendering stages, making the apparent direction of the source harder to discern.

To render chaotic/random/multiple time delays (as noted previously), non-linear filtering may be considered; e.g. frequencies can arrive at each ear with different and/or multiple time delays. This can be achieved by applying a random/chaotic phase delay on to multiple copies of the smoothed HRTF and summing the results.

It will be appreciated that the approach of smoothing HRTFs can be applied independently of using Ambisonics, but that optionally where Ambisonics is used, then for respective Ambisonic channels, corresponding HRTF coefficients appropriately smoothed for the spatial area represented by the channel may be used to deliver an apparently diffuse or volumetric sound source.

Whether or not Ambisonics are used, the approach of smoothing HRTFs may also be used to assist with any one of the three approaches described above relating to finding an HRTF for a user from a library of existing HRTFs created for reference individuals.

In a first approach, using smoothed HRTFs allows for filtration/sifting of the candidate HRTFs. Comparing HRTFs for a specific user on large scale sounds allows a faster HRTF selection, as differences between HRTFs are smoothed out for a large scale source, allowing many candidate HRTFs that have similar large-scale characteristics to be ruled in or out at once. Then increasingly smaller scale sources could be used until only a few HRTFs are being evaluated at a full resolution for 'point' sources.

For the second and third techniques discussed previously, this could be achieved using smoothed HRTFs during the audio tests. Meanwhile for the first, visual based technique, the parameters corresponding to a smoothed HRTF comprise correspondingly wider value ranges.

In a second approach, smoothed HRTFs could be used instead of full resolution HRTFs for example where no HRTF can be found for the user (for example to within a predetermined tolerance) based on the comparisons with the data for the reference individuals as described in the above techniques. Optionally the smoothed HRTF could be a blend of the two or three closest matching HRTFs.

Figure 7:
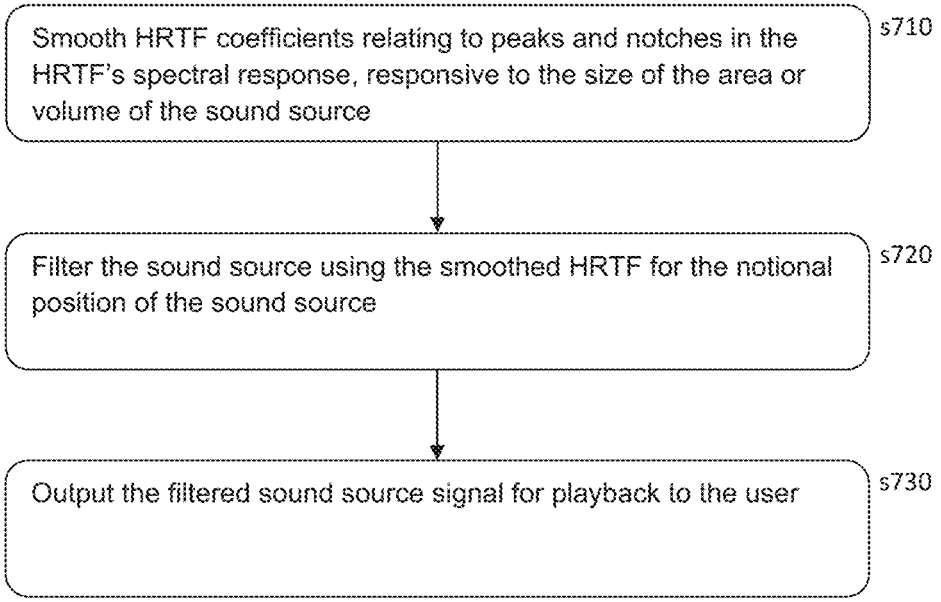
FIG. 7 is a flow diagram of an audio personalisation method for a user, in accordance with embodiments of the present description.

Turning now to FIG. 7, in a summary embodiment of the present invention an audio personalisation method for a user, to reproduce an area-based or volumetric sound source, comprises the following steps.

For a head related transfer function 'HRTF' associated with the user, a first step s710 comprises smoothing HRTF coefficients relating to peaks and notches in the HRTF's spectral response, responsive to the size of the area or volume of the sound source, as described elsewhere herein.

A second step s720 then comprises filtering the sound source using the smoothed HRTF for the notional position of the sound source, as described elsewhere herein.

A third step s730 then comprises outputting the filtered sound source signal for playback to the user, as described elsewhere herein.

It will be apparent to a person skilled in the art that variations in the above method corresponding to operation of the various embodiments of the method and/or apparatus as described and claimed herein are considered within the scope of the present disclosure, including but not limited to that:

the step of outputting the filtered sound source comprises outputting a plurality of instances of the filtered sound source with global delays distributed according to the range of distances from the user occupied by the sound source, as described elsewhere herein;

in this case, optionally the sound source is filtered using a smoothed HRTF for several notional positions, and a different global delay is used for at least one of the notional positions, as described elsewhere herein;

the step of smoothing coefficients of the HRTF comprises smoothing the coefficients proportionally to the size of the area or volume of the sound source, as described elsewhere herein;

the HRTF is smoothed using one or more selected from the list consisting of a moving average filter, a spatial smoothing filter, and an averaging of HRTF coefficients for two or more adjacent HRTF positions, as described elsewhere herein;

the method comprises the steps of applying a random phase delay for each of a plurality of copies of the smoothed HRTF, and summing the results;

the step of outputting the filtered sound uses ambisonics, as described elsewhere herein;

in this case, optionally the sound is played on one or more ambisonic channels corresponding to a spatial distribution of the area-based or volumetric sound source, as described elsewhere herein;

similarly in this case, optionally the sound is additionally played on an omnidirectional channel, as described elsewhere herein; and the step of outputting the filtered sound source for playback to the user is part of a test to identify a previously prepared HRTF for the user from among a library of HRTFs, as described elsewhere herein.

It will be appreciated that the above methods may be carried out on conventional hardware suitably adapted as applicable by software instruction or by the inclusion or substitution of dedicated hardware.

Thus the required adaptation to existing parts of a conventional equivalent device may be implemented in the form of a computer program product comprising processor implementable instructions stored on a non-transitory machine-readable medium such as a floppy disk, optical disk, hard disk, solid state disk, PROM, RAM, flash memory or any combination of these or other storage media, or realised in hardware as an ASIC (application specific integrated circuit) or an FPGA (field programmable gate array) or other configurable circuit suitable to use in adapting the conventional equivalent device. Separately, such a computer program may be transmitted via data signals on a network such as an Ethernet, a wireless network, the Internet, or any combination of these or other networks.

Hence referring back to FIG. 1, an example conventional device may be a PlayStation 4 (as shown) or a PlayStation 5. Accordingly, an audio personalisation system to reproduce an area-based or volumetric sound source for a user (such as a PlayStation system unit 10), may comprise the following.

Storage (22, 37) configured to hold a head related transfer function 'HRTF' associated with the user. A smoothing processor (for example CPU 20A) configured (for example by suitable software instruction) to smooth HRTF coefficients relating to peaks and notches in the HRTF's spectral response, responsive to the size of the area or volume of the sound source. A filtering processor (for example CPU 20A) configured (for example by suitable software instruction) to filter the sound source using the smoothed HRTF for the notional position of the sound source. And, a playback processor (for example CPU 20A) configured (for example by suitable software instruction) to output audio signals corresponding to the filtered sound source for the user.

It will be appreciated that the audio personalisation system may be further configured (for example by suitable software instruction) to implement any of the methods and techniques described herein, including but not limited to:

The audio personalisation system being configured to play a plurality of instances of the filtered sound source with global delays distributed according to the range of distances from the user occupied by the sound source; and the playback processor outputting audio signals using ambisonics.

The foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. An audio personalisation method for a user, to reproduce an area-based or volumetric sound source, comprising the steps of:

for a head related transfer function 'HRTF' associated with the user, smoothing HRTF coefficients relating to peaks and notches in the HRTF's spectral response, responsive to the size of the area or volume of the sound source;

filtering the sound source using the smoothed HRTF for the notional position of the sound source; and outputting the filtered sound source signal for playback to the user.

2. An audio personalisation method according to claim 1, in which the step of outputting the filtered sound source comprises outputting a plurality of instances of the filtered sound source with global delays distributed according to the range of distances from the user occupied by the sound source.

3. An audio personalisation method according to claim 2, in which the sound source is filtered using a smoothed HRTF for several notional positions, and a different global delay is used for at least one of the notional positions.

4. An audio personalisation method according to claim 1, in which the step of smoothing coefficients of the HRTF comprises smoothing the coefficients proportionally to the size of the area or volume of the sound source.

5. An audio personalisation method according to claim 1, in which the HRTF is smoothed using one or more of:

i. a moving average filter;

ii. a spatial smoothing filter; and iii an averaging of HRTF coefficients for two or more adjacent HRTF positions.

6. An audio personalisation method according to claim 1, comprising the steps of:

applying a random phase delay for each of a plurality of copies of the smoothed HRTF; and summing the results.

7. An audio personalisation method according to claim 1, in which the step of outputting the filtered sound uses ambisonics.

8. An audio personalisation method according to claim 7, in which the sound is played on one or more ambisonic channels corresponding to a spatial distribution of the area-based or volumetric sound source.

9. An audio personalisation method according to claim 7, in which the sound is additionally played on an omnidirectional channel.

10. An audio personalisation method according to claim 1, in which the step of outputting the filtered sound source for playback to the user is part of a test to identify a previously prepared HRTF for the user from among a library of HRTFs.

11. A non-transitory, computer readable storage medium containing a computer program comprising computer executable instructions adapted to cause a computer system to perform an audio personalisation method for a user, to reproduce an area-based or volumetric sound source, comprising the steps of:

for a head related transfer function 'HRTF' associated with the user, smoothing HRTF coefficients relating to peaks and notches in the HRTF's spectral response, responsive to the size of the area or volume of the sound source;

filtering the sound source using the smoothed HRTF for the notional position of the sound source; and outputting the filtered sound source signal for playback to the user.

12. An audio personalisation system to reproduce an area-based or volumetric sound source for a user, comprising:

storage configured to hold a head related transfer function 'HRTF' associated with the user, a smoothing processor configured to smooth HRTF coefficients relating to peaks and notches in the HRTF's spectral response, responsive to the size of the area or volume of the sound source;

a filtering processor configured to filter the sound source using the smoothed HRTF for the notional position of the sound source; and a playback processor configured to output audio signals corresponding to the filtered sound source for the user.

13. An audio personalisation system according to claim 12 in which: the audio personalisation system is configured to play a plurality of instances of the filtered sound source with global delays distributed according to the range of distances from the user occupied by the sound source.

14. An audio personalisation system according to claim 12, in which: the playback processor outputs audio signals using ambisonics.

* * * * *